US005188566A

United States Patent [19]

Böhme

[11] Patent Number: 5,188,566

[45] Date of Patent: Feb. 23, 1993

[54] LOOPING SWING WITH PARALLEL ROWS OF SEATS

[75] Inventor: Karl Böhme, Bremen, Fed. Rep. of Germany

[73] Assignee: Huss Maschinenfabrik GmbH & Co., KG, Bremen, Fed. Rep. of Germany

[21] Appl. No.: 597,729

[22] Filed: Oct. 15, 1990

[51] Int. Cl.[5] ..... A63G 1/08; A63G 31/16

[52] U.S. Cl. ..... 472/45; 472/3

[58] Field of Search ..... 472/45, 44, 46, 47, 472/3

[56] References Cited

U.S. PATENT DOCUMENTS 4,643,416 2/1987 van der Veen ..... 472/45

4,807,869 2/1989 Knijpstra ..... 472/45

FOREIGN PATENT DOCUMENTS 2616076 11/1977 Fed. Rep. of Germany ..... 472/45

*Primary Examiner*—Richard E. Chilcot, Jr.

*Attorney, Agent, or Firm*—Merchant, Gould, Smith, Edell, Welter & Schmidt

[57] ABSTRACT

The passenger gondola of a looping swing suspended in pendulum fashion on motor-driven outriggers has parallel rows of passenger seats that are disposed parallel to the axis of rotation of the outriggers and to the axis of swing of the passenger gondola. Here, the head rests of the passenger seats are a short distance from the axis of swing, in order to hold the acceleration forces acting on the passengers, which occur with looping over of the passenger gondola.

Preferably, the position of the passenger gondola relative to the outriggers is locked at a particular angular position. The ride activity is then operated such that the gondola locks in the tilted, forward direction of rotation, and locking is released at about the top dead point of outrigger rotation, so that the passenger gondola executes a loop on the outriggers overtaking it.

8 Claims, 8 Drawing Sheets

LOOPING SWING WITH PARALLEL ROWS OF SEATS

DESCRIPTION

Figure 1:
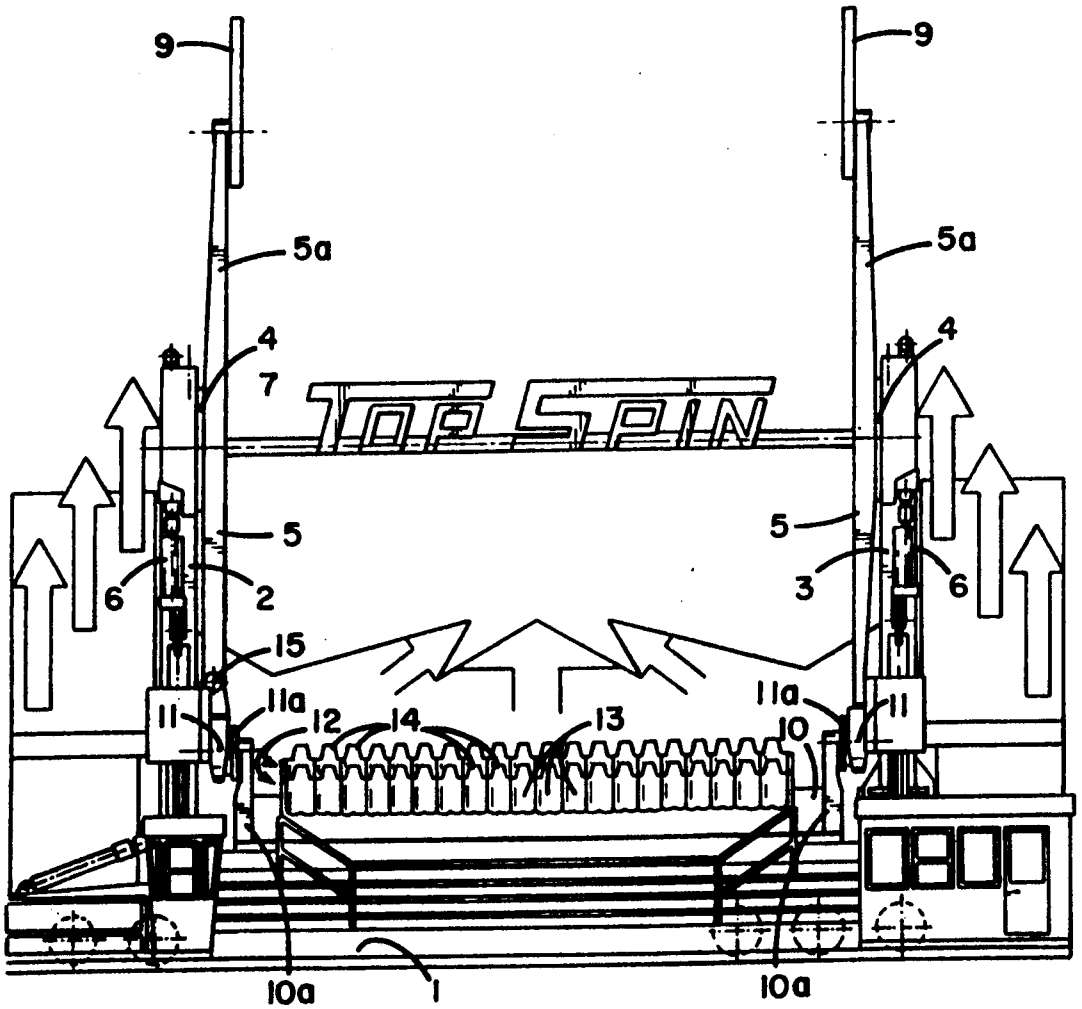

The invention relates to a looping swing with a passenger gondola that is suspended at it ends in pendulum (swinging) fashion between two parallel outriggers which, in turn, are journaled in rotatable fashion and capable of being driven in motorized fashion about an axis running between two vertical supports disposed on a frame, with the passenger gondola carrying rows of passenger seats that run parallel to the axis of the outriggers in a side by side arrangement.

A ride activity of this type has been proposed by DE-A-33 21 599 with the goal of enabling, with an impressive sensation of traveling, a swift and work-saving assembly and disassembly. This latter should be accomplished by supports that can be telescoped and hinged in pivotable fashion to the chassis. The traveling sensation, on the other hand, corresponds to the usual looping swing with a gondola suspended in freely swinging fashion on outriggers.

It has been shown that the riding activity contemplated with this known looping swing (page 10, middle paragraph of DE-A-33 21 599) is not capable of being realized. In order to achieve loopings of the passenger gondola, the passengers must be exposed to such high accelerations in the rows of seats arranged relatively far below the axis of rotation that the looping operation, from the medical point of view, can not be justified.

In comparison to this, the object of the invention is to impart to the passengers, with the relatively simple means of the usual looping swing, an interesting riding experience, without exposing them to excessive—even though high—accelerations, and actually independently of the seat position of the individual passengers in the passenger gondola, such as is about the case with the ride activity of EP-B1-140 238 (with which there is also no looping of the gondola possible).

This objective is met in accordance with the invention by the fact that the passenger seats are arranged with their head rests at only a small distance from the axis of swing of the passenger gondola. In this way, prevented with simple means is that the head/neck region of the passenger be exposed to overly great accelerations. Then, with looping of the passenger gondola, the centrifugal force field of gondola rotation possibly adds itself to that of rotation of the outriggers; in the swing-down phase, further occurring is the earth's acceleration. The resulting total acceleration can work out to be critical, above all in the region of the cervical spine when it is aligned perpendicularly to the spinal column (whipping effect). Taking into consideration a suitable distance of the total center of gravity of the (occupied) gondola from the axis of swing, the arrangement is undertaken such that the horizontal component of the distance of the head from the axis of swing is relatively small. In comparison to this, the vertical component of this distance hardly plays a role: if the the passenger's head is located somewhat below the axis of swing, the centrifugal force of the loop expresses itself in a non critical compressive force on the spinal column.

The arrangement of the passenger seat head rests near the axis of swing can be realized in different ways. In the case of rows of seats facing in the same direction and arranged in terrace form one behind the other, the distance of the back row of seats can and should be greater, in the direction of viewing, than the forward seats, because the head rests of the back row are facing toward the axis of swing, the heads of the passengers sitting there therefore being pressed against the head rests when looping while (for reasons of space) the seats of the forward row must be arranged so far forward that the axis of swing lies behind their head rests and passengers, at the time of looping, are forced to a slight pitching movement (forwardly). However, it is also possible to arrange two rows of seats symmetrically to the axis of swing, namely back to back, so that the axis of swing runs through between (and possibly above) the head rests.

Preferably associated to the pendulum bearings of the passenger gondola (on the pendulum arms) are locking contrivances with which the passenger gondola can be fixed in a particular angular position relative to the outriggers. An arrangement of this type permits a riding cycle which will yet be gone into below.

In particular, any locking contrivance consists of a brake that is arranged in the outrigger concentrically to a brake drum mounted on the gondola-side bearing part. This enables not only locking the gondola relative to the outriggers in any arbitrary angular position, but rather—dependent upon braking force—also enables an influencing of the swinging (pendulum) movement of the passenger gondola when such would be desired or required.

Another further evolution of the new looping swing consists in the fact that each pendulum arm (of the passenger gondola) is held in cardanic fashion on a shaft attached to the outrigger, with an axis running transversely to the axis of rotation, and capable of traveling out at a small angle relative to the outrigger. Prevented in this way are stresses in the supports, the outriggers and/or the passenger gondola with its pendulum arms, which occur because of irregularities in setting up, in particular a ride activity, and are just about unavoidable. Here, the out-travel angle can be limited by a prebiased, ring-shaped rubber element that is arranged on a coaxial projection of the shaft and encompassed by the pendulum arm. The rubber element simultaneously damps load-change movements, as occur with looping over of the passenger gondola.

Likewise serving for equalizing possibly-occurring stresses is that one of the outriggers is divided transversely to its radially longitudinal extension, and both parts are pivotably limited relative to one another about an axis running transversely to the axis of rotation of the outriggers.

Finally, there exists an advantageous measure for the travel activity of a looping swing equipped for this with a chassis, in that, for loading the chassis, provided is a water tank consisting of ring elements capable of being telescoped into one another and/or capable of being retracted coaxially vertically, with, on the inside, in the top ring in the extended condition, there being attached a flexible container lining the ring elements in the extended condition which, in the pushed-together (empty) condition is folded together. It is in this manner that the supporting device for the required amount of water can be accommodated on a relatively small surface area, without that the total allowable height of the water tank be exceeded in the riding condition—when the tank is emptied.

The invention further extends to a special method for driving a looping swing of the present type. This method is characterized by the fact that when beginning a travel cycle the outriggers first travel out from their perpendicularly, downwardly directed position against the forward direction of rotation by an acute angle, and the pendulum arms of the still further, perpendicularly hanging passenger gondola are locked relative to the outriggers, that after this the outriggers (with the forwardly tipped passenger gondola) are turned in the forward direction and the locking system is removed when—shortly before reaching the outrigger zenith position—the gondola center of gravity has passed the perpendicular through the pendulum axis. This last-mentioned measure leads to a forwardly-directed tilting down of the passenger gondola previously moved into a head-over (up side down) position. The gondola swings through about its pendulum axis and at the same time is "overtaken" to a certain extent by the further-rotating outriggers, so that, without any further influencing and "away from the stand", there results a looping of the passenger gondola.

The runoff of the looping process can be influenced in time and space by the driving rpm, such that a further looping does not occur, only a second looping, etc. Also, provided locking of the passenger gondola relative to the outriggers is undertaken with the aid of a brake, this latter can be used for immediate influencing of the swinging process.

Figure 2:
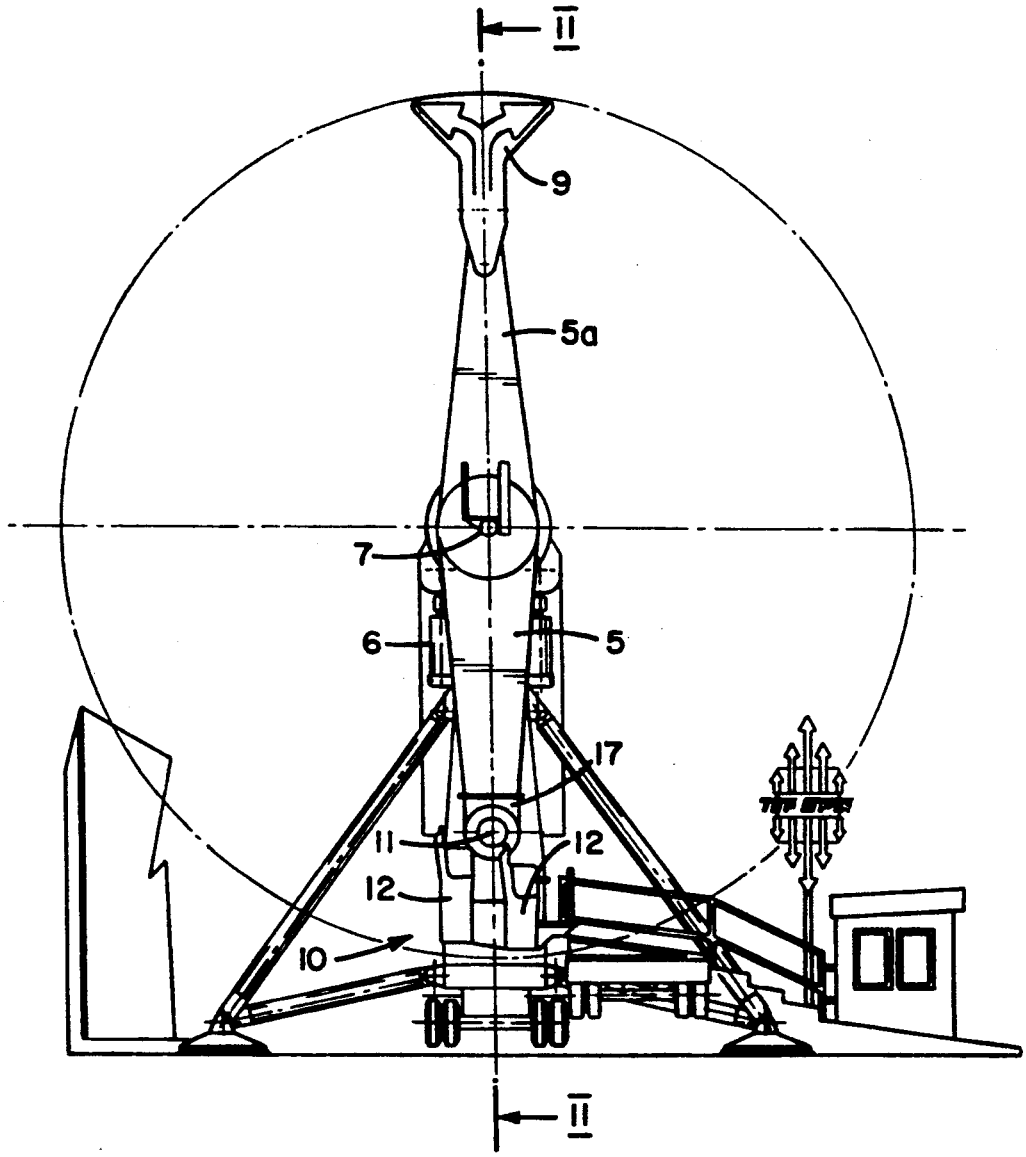
Figure 3:
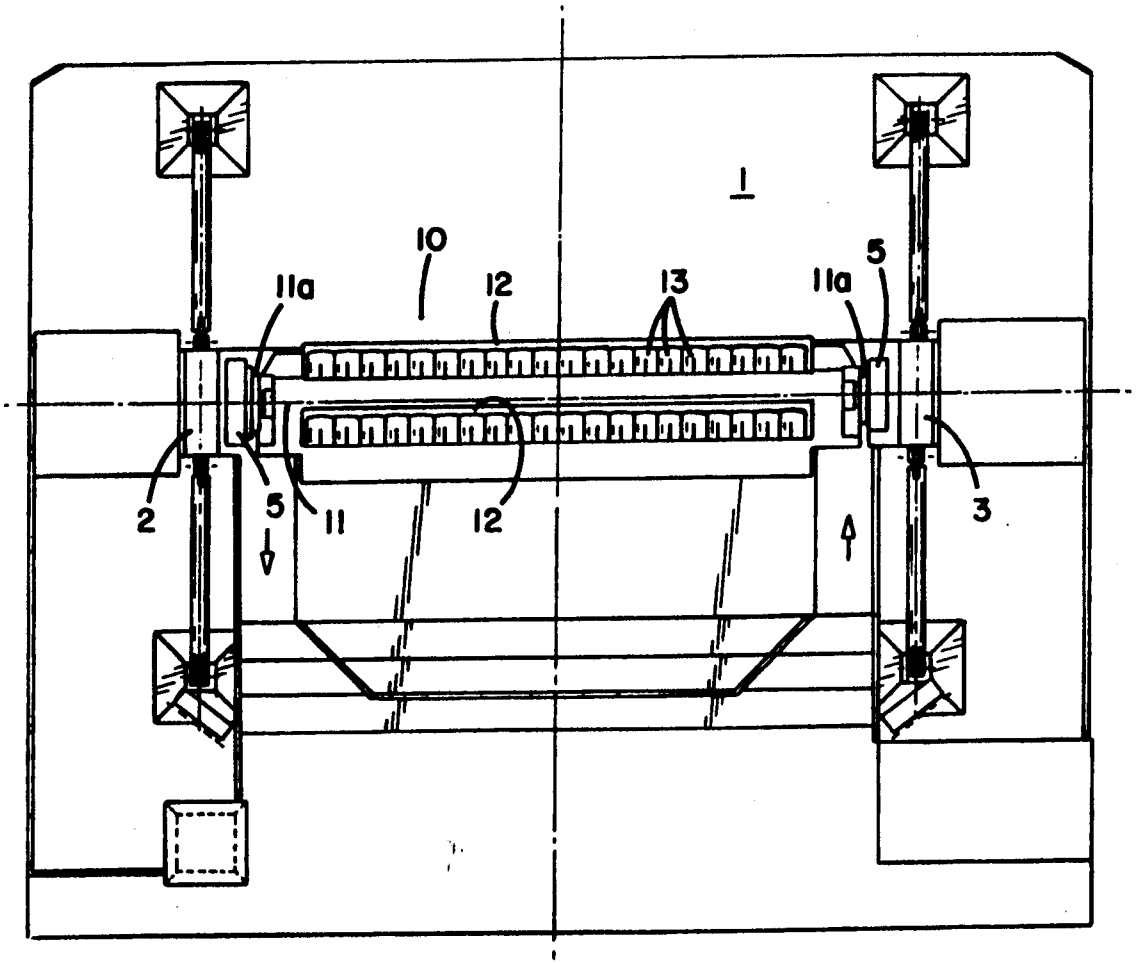
Figure 8:
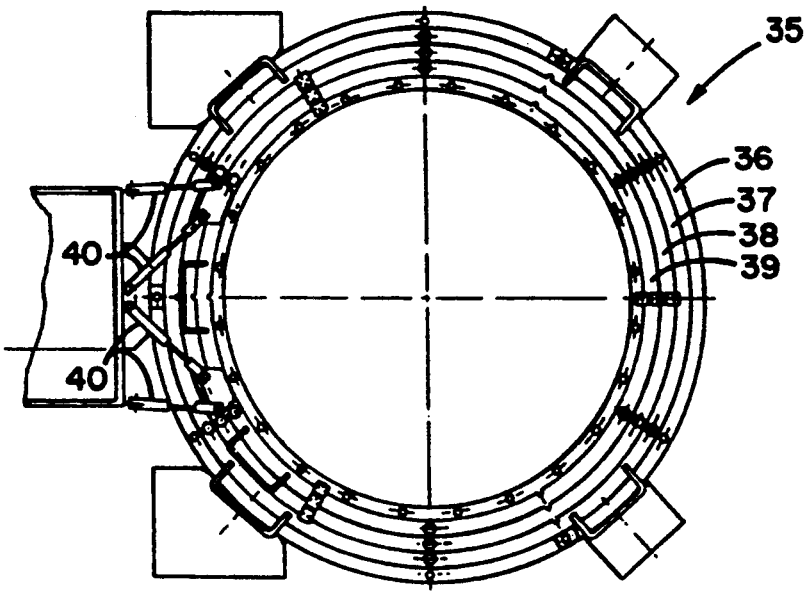
Figure 4:
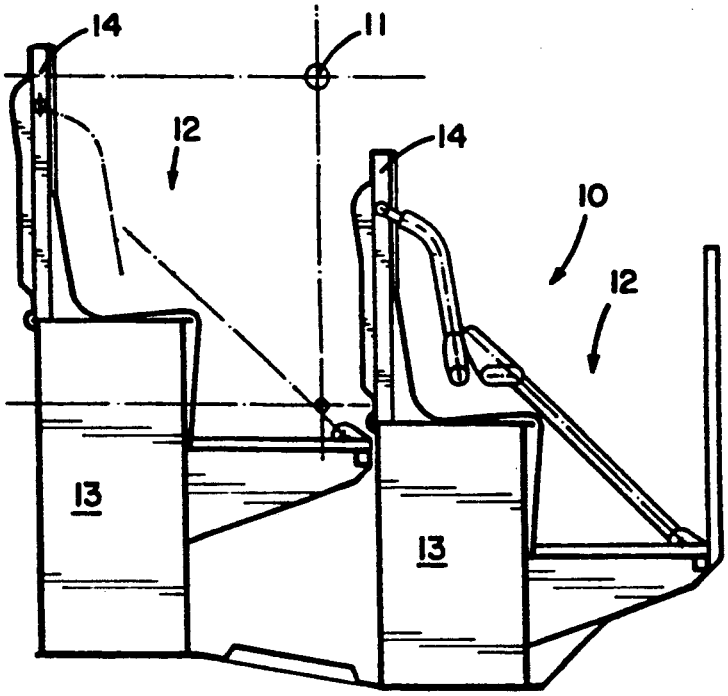
Figure 5:
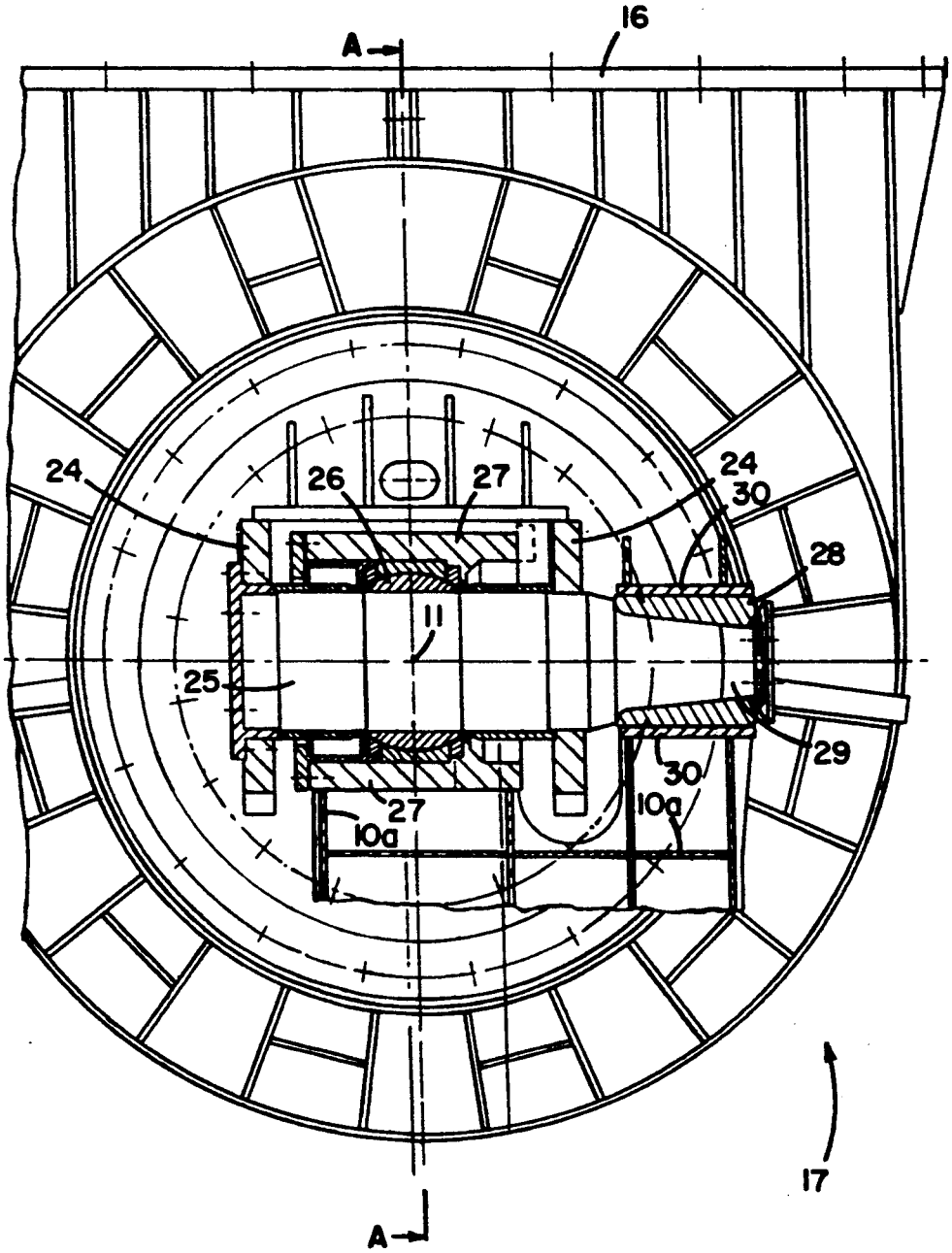
Figure 6:
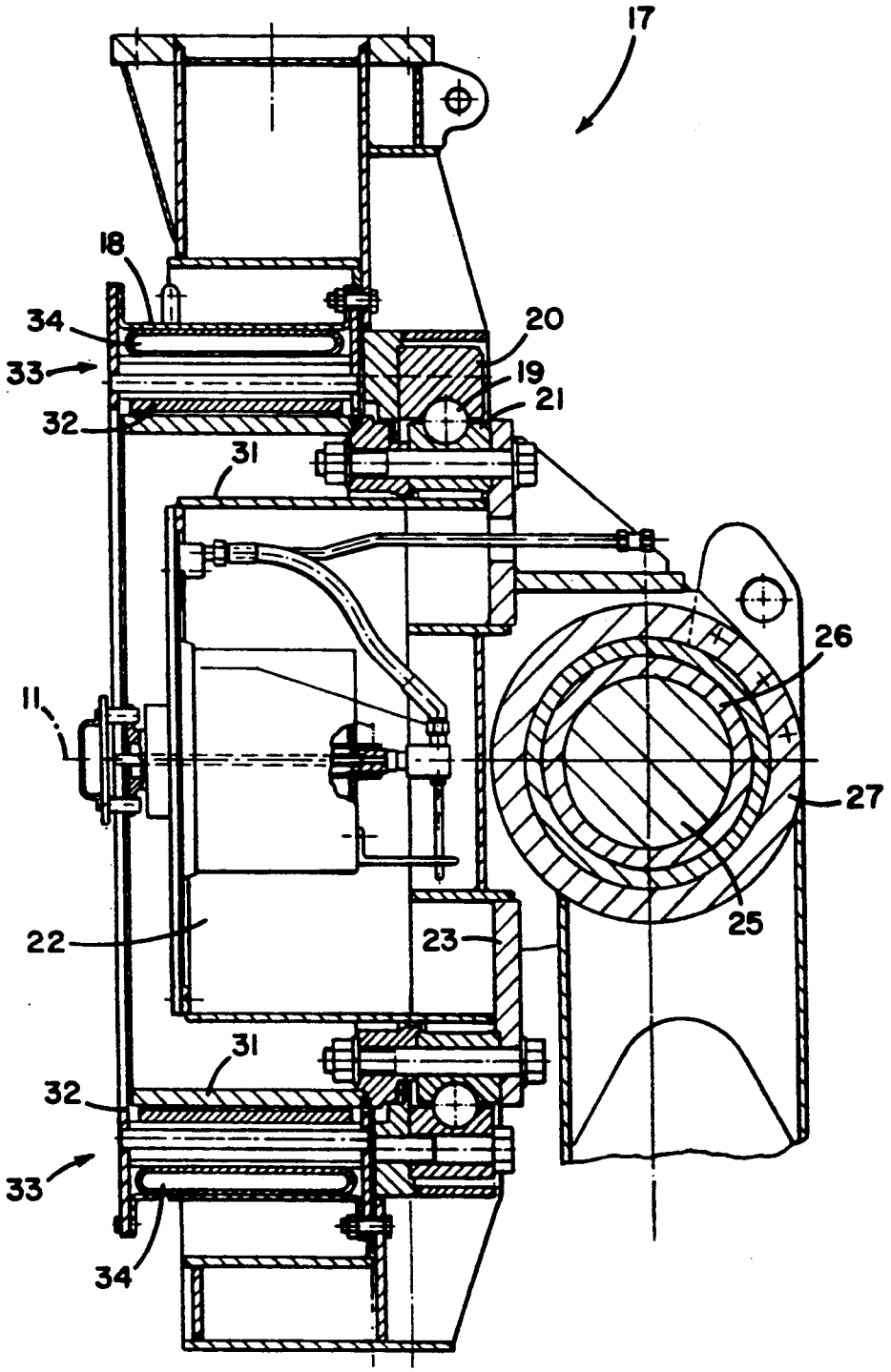
Figure 7:
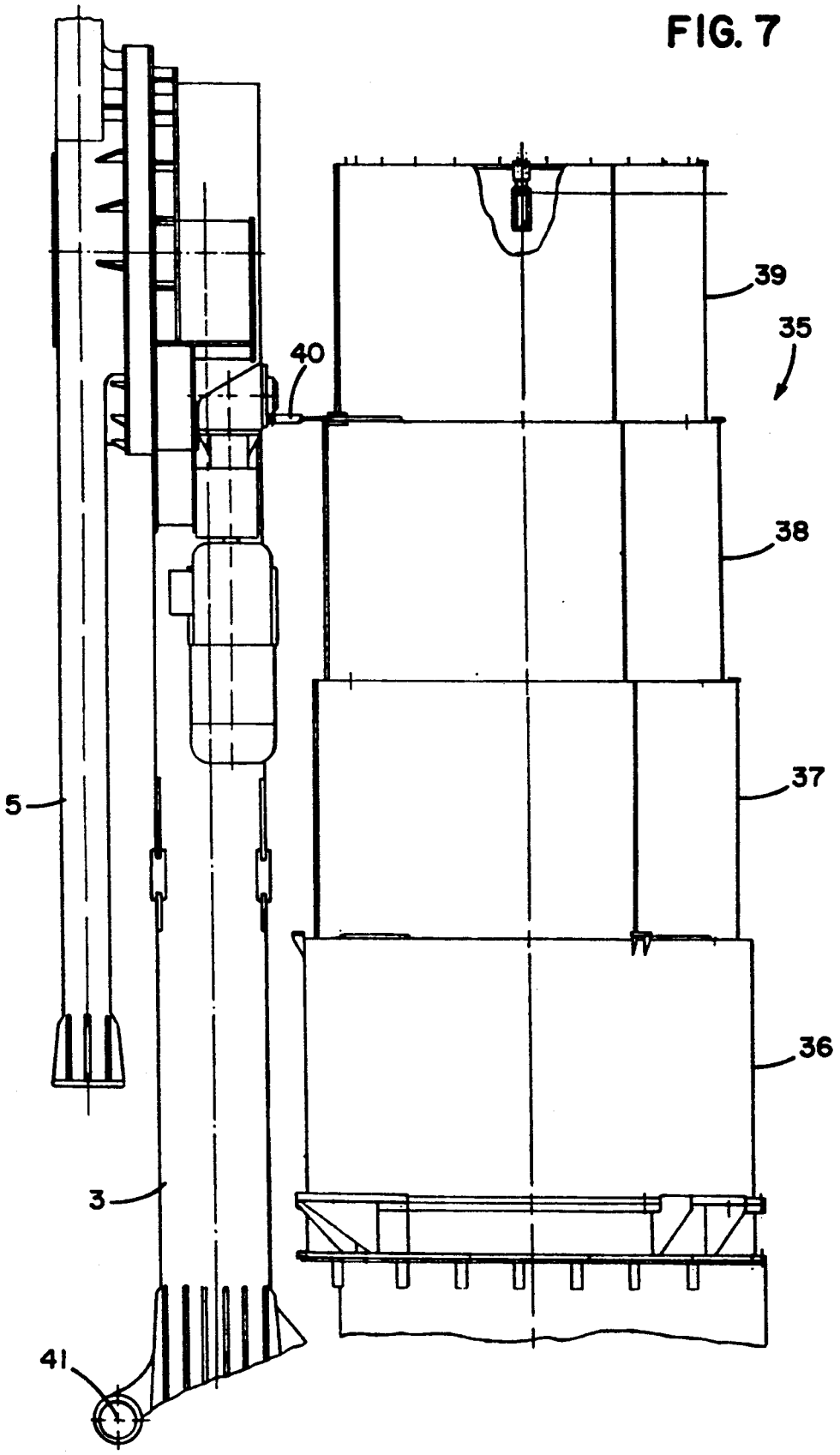
Figure 9A:
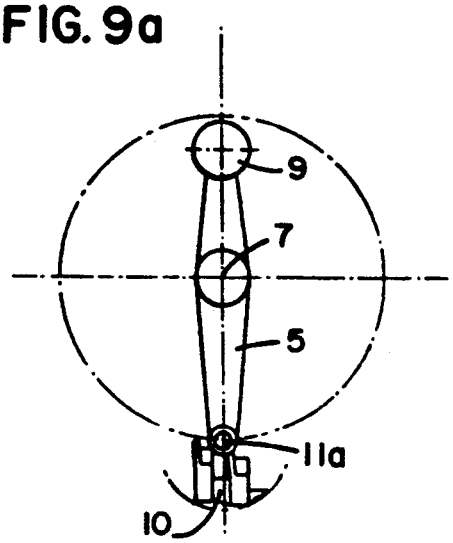
Figure 9B:
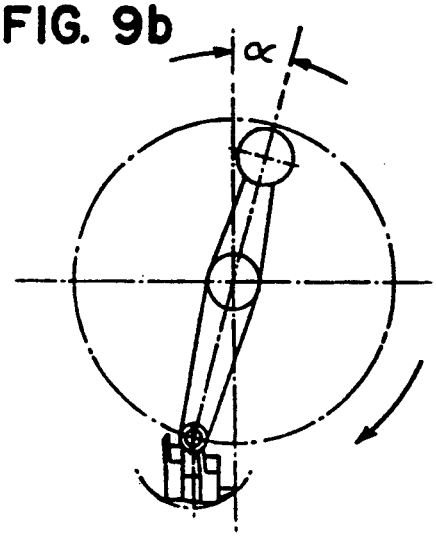
Figure 9C:
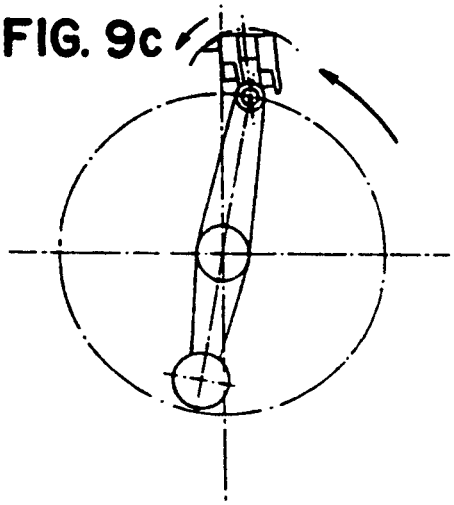
Figure 9D:
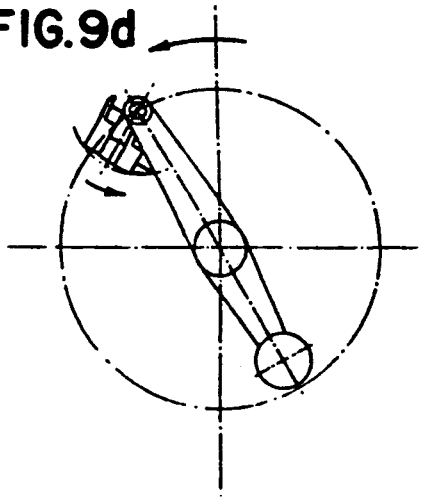
Figure 9E:
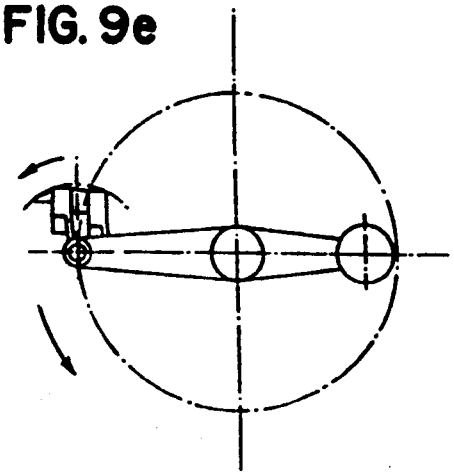

The drawings illustrate the invention and its further development by means of examples of embodiment. Shown are:

FIG. 1 the new ride activity in a front view;

FIG. 2 in a side view;

FIG. 3 in a top view;

FIG. 4 the arrangement of the rows of seats in an enlarged scale;

FIG. 5 a (partially cut) top view onto a bearing of the gondola pendulum arms on the outriggers;

FIG. 6 a cut along the line A—A in FIG. 5;

FIG. 7 a side view of a water tank serving for loading a ride activity in the operating condition;

FIG. 8 a top view onto the water tank in FIG. 1; and

FIG. 9 a schematic representation of the course of a travel cycle, respectively a revolution of the outriggers.

Fastened to a chassis (platform) 1 are two vertical supports 2 and 3. Journaled at the upper ends of the supports 2, 3 are the hubs 4 of outriggers 5, which can be driven in direction-of-rotation-reversing manner and with regulated speed of rotation by electric motors 6. Both drives are coupled with one another by means of a Cardan shaft 7.

On the other sides of the hubs 4, the outriggers 5 have counter pieces 5*a* on which are attached counter weights 9. These latter are preferentially dimensioned such that their total weight corresponds to the total weight of the passenger gondola 10 with half occupancy. On the ends, the passenger gondola 10 is journaled in freely swinging fashion in the free ends of the outriggers 5, about the axis 11 extending parallel to the axis 7, and actually by means of pendulum arms 10*a* that are short in comparison with the outriggers 5. A brake—represented in FIG. 6—is associated to each bearing 11*a*, with which the swinging movement of the passenger gondola 10 can be influenced, and/or the pendulum arms 10*a* can be locked at a predetermined angular position relative to the outriggers 5. Two rows 12 of seats 13 for passengers are arranged at different heights in terrace fashion in the passenger gondola, and actually such that the row 12 extends parallel to the axis 7.

The arrangement of the seats 13 relative to the axis of swing 11 is shown in FIG. 4. The seats 13—in the direction of viewing of the passengers—of the back row of seats 12 have head rests 14 which, with a quiescent gondola 10, are located at the same height as the axis 11 and at a horizontal distance of about 1 m back thereof. The head rests 14 of the front row of seats 12 that are arranged somewhat lower lie correspondingly low and under the axis of swing 11, but at the same time also ahead of this latter at a horizontal distance that is less than that of the other row 13. The total center of gravity (gravity line) $S_{Ges}$ of the gondola 10 lies below the axis of swing 11 and therewith between the rows of seats 13.

The left hand outrigger 5 in FIG. 1 is divided transversely and the two parts are somewhat pivotable relative to one another about the axis 15, so that a non parallelism of the two outriggers 5 does not lead to stressing forces on the gondola 10; the construction of the bearings 11*a* described in the following is to be considered as supplementary.

The bearing 11*a* represented in a larger scale in FIG. 5 is attached to the outrigger 5 with the flange 16 (FIG. 1), so that its housing 17 in each case forms part of the outrigger 5. Also belonging to this is the housing 18—recognizable in FIG. 6—of a braking contrivance that will described in more detail in the following. Held in the housing 17 is a ball bearing slewing gear 19 with its outer ring 20; its inner ring 21 is part of a hub 22 of the bearing 11*a*.

Attached to a plate 23 are bearing brackets 24 that hold a shaft 25 on the hub 22. Journaled cardanically on the shaft 25, through the intermediary of a ball-ring segment 26, is a sleeve 27 on which is attached the pendulum arm 10*a* of the gondola 10. In this manner, each pendulum arm 10*a* can throw out slightly relative to the bearing 11*a*. Each movement of this type is limited and damped by an axially biased rubber ring 28 that is located on a coaxial projection 29 of the shaft 25, and surrounded on the outside by a sleeve 30 on the pendulum arm 10*a*.

Attached to the other side of the plate 23 is a brake drum 31 that cooperates with the brake linings 32 of a brake designated overall with 33 that surrounds the brake drum 31 concentrically. The brake 33 is laid out such that it can withstand the torque that is exerted by a passenger gondola 10 that is angled away relative to the outrigger 5, even in the fully occupied condition during runoff of the above-described operating cycle. Actuation of the brake 33—which because of its foregoingly explained layout simultaneously represents a locking contrivance—is accomplished with the aid of a concentric hose 34 which, on the outside, can exert a radially-inwardly-directed force on the radially-movable brake shoes 32 with the aid of compressed air.

Outwardly from the support 3, FIG. 7 shows a water tank designated overall with 35, which is omitted in FIG. 1 but that is in a position, with the aid of the weight of the water, in the operating condition, to load the chassis (not represented in FIG. 7) of a ride activity indicated there. The water tank 35 consists of four concentric, respectively coaxial, ring elements 36, 37, 38 and 39, having a vertical axis, pushed into one another, which, when emptying the water tank 35, can be pushed together downwardly after the connectors 40 have been released. Located inside element 39 is a container (not represented) made of an appropriate plastic film or the like, which is attached at the upper rim of the top ring 39 and that can be folded together in the lower part of the water tank 35 when this latter is emptied and pushed together for the ride operation.

As the bearing eye 41 in FIG. 7 permits recognizing, the supports 2, 3 are tiltably hinged opposite to one another on the frame about axes running transversely to the axes 7, 11, as well as horizontally, when the looping swing is constructed as a mobile ride activity. Here, the tilt axes are arranged at different heights above the frame, because they then can be laid down over one another with the hubs 4 of the outriggers 5 for transport, and thereby in a space-saving fashion as well as in a transport-secure fashion.

FIG. 9 shows, in phases a)–e), the course of a travel cycle with one rotation of the outriggers 5 along with a looping of the gondola 10. In the position a), we are dealing with the initial or at-rest position in which the passengers can get in and get out. The outriggers 5 are directed downwardly and the gondola 10 hangs down in their radial extension. At the beginning of the travel operation, the outriggers 5 are first thrust out in the clockwise direction by the angle $\alpha$. In so doing, the gondola 10, like before, hangs perpendicularly downwardly so that its vertical principal plane, with the principal plane of the outriggers 5, includes the angle $180-\alpha$. When this angular position is reached, the size of which was predetermined, the brakes 33 lock in the aforementioned angular position between the outriggers 5 and the gondola 10 (position b).

Now, the outriggers 5 are rotated counterclockwise and take along with them the locked gondola 10 in unchanged relative position, so that this latter moves into the head-over position illustrated by FIG. c). The position c) at the same time illustrates the moment at which, shortly before reaching the top dead point (zenith position) of the outriggers 5, the center of gravity of the gondola 10, because of its tilted position relative to the outriggers 5, has reached the other side thereof and, therefore—in the representation of c)—has already reached an unbalance for likewise rotating counterclockwise. At this moment, brakes 33 are released and locking is ended.

Therewith, as FIG. e) shows, the gondola 10 can tilt down and execute a rotation counterclockwise. Since the outriggers 5 rotate further in doing this, they support the looping of the gondola 10, which occurs approximately in the horizontal position of the outriggers 5, as this is shown in FIG. e).

I claim:

1. A mechanical swing for carrying passengers comprising:

a platform (1) with vertical supports (2, 3), the vertical supports having top portions;

two parallel outriggers (5) having first and second ends, the parallel outriggers being journaled in rotatable fashion proximate the top portions of the vertical supports (2, 3) so that motor (6) rotates the outriggers (5) about an axle (7);

a passenger gondola (10) suspended by pendulum arms (10*a*) from the first ends of the parallel outriggers (5) to rotate about a swing axis (11);

a front and back row of generally adjacent passenger seats (13) terraced at different heights in the passenger gondola (10) and arranged so that the passengers are facing in a direction generally perpendicular to the swing axis (11), the seats (13) having head rests (14) and the front and back rows of passenger sets being arranged so that the head rests (14) are proximate the swing axis (11) such that the horizontal distance from the head rests (14) on the back row of seats to the swing axis (11) on the front row of seats to the swing axis (11).

2. The apparatus of claim 1 further including a locking mechanism (33) between the pendulum arms (10*a*) and the first ends of the outriggers (5) for retaining the gondola (10) at a certain angle ($\sigma$) with respect to the outriggers (5).

3. The apparatus of claim 2 further including a bearing (11*a*) between the pendulum arm (10*a*) and the first ends of the outriggers (5), wherein the locking mechanism (33) comprises a brake attached to the outriggers (5) in concentric alignment with a brake drum (31) engaged to the pendulum arm (10*a*) proximate the bearing (11*a*).

4. The apparatus of claim 1 wherein the pendulum arms (10*a*) of the gondola (10) are connected to the outriggers (5) by a shaft (25), the shaft (25) being mounted transverse to the swing axis (11) to allow Cardan motion of the pendulum arms (10*a*).

5. The apparatus of claim 4 wherein the Cardan motion of the shaft (25) is limited by a rubber element (28) which is arranged on an axial extension (29) of the shaft (25).

6. The apparatus of claim 1 wherein one of the outriggers (5) is subdivided into first and second portions, the first and second portions being pivotally joined at an axis (15) running transversely to the axis of rotation (7) of the outrigger (5).

7. The apparatus of claim 1 further including a water tank (35) for loading the platform (1), the water tank (35) comprising a series of telescopically engaged concentric ring elements (36–39), the ring elements having an extended position along a vertical axis and a collapsed position, the water tank (35) further including a flexible container for lining the ring elements in the extended position.

8. A method of operating a mechanical swing for carrying passengers, comprising the steps of:

a) providing a platform (1) with vertical supports (2, 3), the vertical supports having top portions, two parallel outriggers (5) having first and second ends, the parallel outriggers being journaled in rotatable fashion proximate the top portions of the vertical supports (2, 3) so that motor (6) rotates the outriggers (5) about an axle (7), and a passenger gondola (10) suspended by pendulum arms (10*a*) from the first ends of the parallel outriggers (5) to rotate about a swing axis (11);

b) locating the outriggers (5) in the vertically downward position so that the first ends of the outriggers (5) are proximate the platform (1);

c) deflecting the outriggers (5) through an acute angle ($\sigma$) in the clockwise direction so that the pendulum arms (10*a*) of the gondola (10) remain in the vertically downward position;

d) locking the pendulum arms (10*a*) in position with respect to the outriggers (5);

e) rotating the outriggers (5) in the counterclockwise direction; and f) releasing the pendulum arms (10*a*) shortly before the outriggers (5) reach the vertically upward position so that the center of gravity of the gondola (10) passes through a vertical plane intersecting the swing axis (11), causing the gondola to execute one rotation about the swing axis (11).

* * * * *

UNITED STATES PATENT AND TRADEMARK OFFICE

CERTIFICATE OF CORRECTION

PATENT NO. : 5,188,566

DATED : February 23, 1993

INVENTOR(S) : Karl Bohme

It is certified that error appears in the above-identified patent and that said Letters Patent is hereby corrected as shown below:

Column 6, line 4, after "(11)" insert --is greater than the horizontal distance from the head rests (14)--

Signed and Sealed this

Fourteenth Day of December, 1993

*Attest:*

*Attesting Officer*

BRUCE LEHMAN

*Commissioner of Patents and Trademarks*